US006052961A

United States Patent [19]

Gibbs

[11] Patent Number: 6,052,961

[45] **Date of Patent: *Apr. 25, 2000**

[54] ROOF MOUNTING ASSEMBLY

[76] Inventor: Alden T. Gibbs, 158 Conduit St., Annapolis, Md. 21401

[ * ] Notice: This patent is subject to a terminal disclaimer.

[21] Appl. No.: 09/013,352

[22] Filed: Jan. 26, 1998

Related U.S. Application Data

[63] Continuation-in-part of application No. 08/689,025, Jul. 30, 1996, Pat. No. 5,794,396

[60] Provisional application No. 60/036,430, Jan. 27, 1997.

[51] Int. Cl.[7] ..... E04D 1/00

[52] U.S. Cl. ..... 52/518; 52/520; 52/546

[58] Field of Search ..... 52/518, 520, 546, 52/547, 550, 551, 544

[56] References Cited

U.S. PATENT DOCUMENTS 3,380,214 4/1968 Stevens .
4,958,471 9/1990 Waddington .
5,577,360 11/1996 Gibbs .
5,617,690 4/1997 Gibbs .
5,642,596 7/1997 Waddington .

FOREIGN PATENT DOCUMENTS 9460521 10/1994 Australia .

*Primary Examiner*—Beth A. Aubrey
*Attorney, Agent, or Firm*—Connolly Bove Lodge & Hutz LLP

[57] ABSTRACT

A roof mounting assembly includes rows of pans mounted to the understructure of a roof by hooking the pans around support tracks. Rows of roofing panels are mounted over the respective rows of pans with adjacent roofing panels generally abutting each other to create a joint located above the central area of an underlying pan so that the pan acts as a barrier to prevent rain water and the like from flowing through the joint and directly to the understructure. By using underlying pans to prevent leakage, it is possible to minimize the amount of panel overlapping. The panels are preferably mounted to the tracks by separate hook members. The upper end of each panel is between and against an overlying panel and an underlying track.

27 Claims, 11 Drawing Sheets

ROOF MOUNTING ASSEMBLY

CROSS-REFERENCE TO RELATED APPLICATIONS

This application is based upon provisional application Ser. No. 60/036,430, filed Jan. 27, 1997. This application is also a continuation in part of Ser. No. 08/689,025, filed Jul. 30, 1996, now U.S. Pat. No. 5,794,396.

BACKGROUND OF THE INVENTION

The present conventional roofing techniques involve an overlapping of the roofing panels. For example, in order to minimize leakage through the joints of abutting panels in a row, a further row of panels is mounted over the underlying row in a staggered manner to cover the joints. Added overall panel thickness results by overlapping the rows of panels from the base edge of the roof upwards. The multiple thickness results in excessive weight and cost. Where sufficient measures are not taken to seal the joints, there is the tendency to permit water, such as rain, to flow through the joint of adjacent panels and directly contact the understructure. Where a wooden deck is used as the understructure, the water can cause the wooden deck to rot. Where a metal deck is used the water can cause corrosion.

A known system marketed under the name roof lock systems by GREAT SLATE PTY LTD. of Adelaide, Australia is described in Australian patent application no. 60521/94 and counterpart U.S. Pat. No. 5,642,596. The '596 patent discloses essentially two embodiments. In one embodiment illustrated in FIGS. 1–4 the joining strips 13 are mechanically interlocked with battens of generally Z-shape by having marginal flanges 15 extend below the main portion of the strip. The flanges includes slots 16 which engage an upper edge of the batten near the lower end of the strip. The strip includes a pair of tabs 20 at its lower end, each of which would be crimped over a respective shingle to hold the shingle in place. The strip is of a length so that its upper end rests against the vertical portion of the Z-shaped batten rather than on the upper surface. In a further embodiment shown in FIGS. 5–6 the upper end of the strip 13 has, in additional to marginal flanges 15, an L-shaped bracket which extends upwardly from its main surface and is mounted over the upper surface of the batten. Instead of having tabs to hold the shingles a bent locking finger is located at the upper portion of the strip to hold a single shingle.

It would be desirable to provide a roofing assembly which adopts some of the advantages of the embodiments described in the '596 patent while having its own advantages such as in ease of installation, improved appearance and compliance.

SUMMARY OF THE INVENTION

An object of this invention is to provide a roofing assembly which mounts the panels with reduced weight and cost benefit.

A further object of this invention is to provide a roofing assembly which minimizes the possibility of water leaking through the joint between adjacent panels to thereby prevent direct access to the understructure.

A still further object of this invention is to provide a roofing assembly which facilitates installation while providing a compliant attachment.

A yet further object of this invention is to provide a roofing assembly which provides ventilation around the roofing panels.

A further object of this invention is to provide a roofing assembly which includes some of the advantages of the embodiments described in the above noted '596 patent with added advantages of its own regarding the ease of assembly.

Another object of this invention is to eliminate some of the problems associated with conventional applications and with the '596 patent, for example: gapping, inflexibility, weakness of tabs, quantity of metal, and difficulty of pan repair and replacement.

In accordance with a preferred practice of this invention a row of pans is mounted under each row of roofing panels by hooking the pans around support tracks or battens. The pans are located so as to be staggered with respect to the roofing panels whereby the joint between adjacent roofing panels is located between the edges and preferably in the central portion of each pan. Hooks may be used to mount the panels to the tracks or battens with the pans therebetween. The pan is preferably of a length corresponding to the length of the roofing panels so that at the location of the joints there is an imperforate barrier between the roofing panels and the understructure.

The pan may include some form of indicia to facilitate the roofer knowing where the longitudinal edge of each panel should be located.

Each pan preferably terminates at its upper end in a hook structure which bends downwardly and inwardly from the pan surface and under the pan surface so that the pans can be mounted to, for example, tracks on the roofing deck by being hooked over the tracks or by being hooked over battens of the understructure. The hook structure of the panels may include a portion where the hook structure begins which extends upwardly away from the main plane of the panel to act as a windstop. In other variations, hooks are provided at the base or undersurface of the pan.

The pans may contain water traps at the location of the panel joints. Such water traps could be in the form of depressions in the pans, which may decrease in depth from the top to the bottom portion of the pan to prevent lateral or vertical penetration of water underneath the panels.

In accordance with a further embodiment of the invention a track, such as a Z-shaped track has an offset wall which terminates in a barb or downwardly inclined edge. The fastener includes a complimentary barb or hook which engages the barb of the track.

The fasteners may include stiffeners. Similarly, the tracks may include stiffeners which may be provided with weep holes. A detachable sheath may be provided over the panel engaging surface of the track to serve as a barrier for protecting the track.

The pans may be secured to the tracks by hook structure formed from a wire which is wrapped completely around the front surface of the pan and has a bend at the front surface to form a panel mounting hook. The wire is also wrapped partially around the rear surface of each pan to terminate in hook structures at each end thereof for fitting around a track or the pan or part of the understructure.

THE DRAWINGS

FIG. 15A is a front elevation view showing the decorative effect of the pans of FIGS. 14–15;

DETAILED DESCRIPTION

The present invention involves a roofing or siding assembly wherein the roofing or siding panels may be mounted in an overlapping manner so that a minimal overall thickness of the panels results. This arrangement is particularly advantageous where slate material is used as the panels. The term "slate" is intended to mean natural or synthetic slate, as well as other rigid panel material. The invention, however, may be practiced with any form of shingles or panels. The invention is practiced by the utilization of a pan beneath the panels to create a barrier at the joint of adjacent panels so as to minimize the possibility of water having direct access to the understructure through the joint.

It is to be understood that although the following description refers to the invention in terms of being a roofing assembly wherein the roof structure is horizontal or at a generally horizontal angle, the invention may also be practiced with more vertical type arrangements such as in the siding of walls. Thus, the reference to "roofing" assemblies is not intended to exclude siding assemblies.

Figure 1:
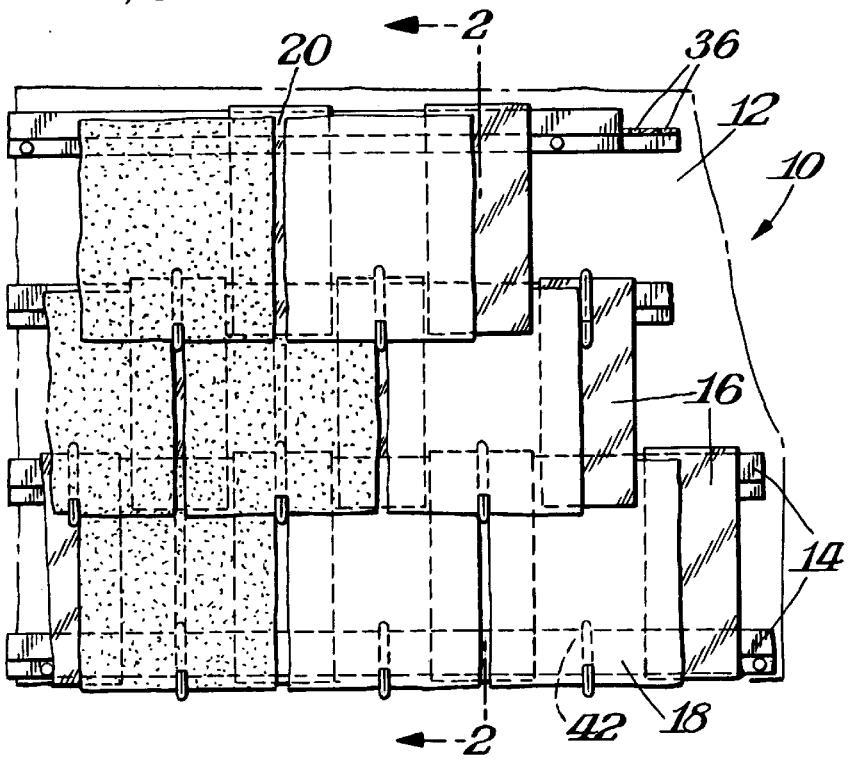
FIG. 1 is a top plan view showing a portion of a roofing assembly in accordance with this invention.
Figure 2:
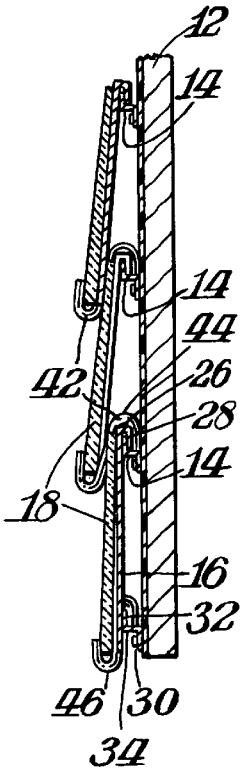
FIG. 2 is a cross-sectional view taken through FIG. 1 along the line 2—2.

FIGS. 1–2 show a portion of a roof utilizing the roofing assembly 10 in accordance with this invention. As shown therein the roof would include some form of understructure such as a deck 12 which could be made of wood or metal. A plurality of tracks 14 is mounted at spaced locations on deck 12. In a broad sense the tracks might also be considered as part of the understructure. Tracks 14 may take the form of tracks described in my U.S. Pat. Nos. 5,577,360 and 5,617,670, all of the details of which are incorporated herein by reference thereto. Thus, the invention may be practiced by using any of the techniques of those applications for mounting the panels to the tracks or roofing understructure where appropriate. The present invention also involves the provision of rows of pans 16 mounted to the respective tracks in manners later described. Roofing panels 18, such as slates are mounted in rows on top of pans 16. The panels 18 are staggered with respect to the pans 16 so that the joint 20 between abutting panels is located intermediate the side edges of an underlying pan. Each pan is preferably imperforate, particularly, at the location of the joint. Each pan thus functions as a flashing or barrier to minimize the possibility of water, such as rain water, flowing through the joint and directly contacting the understructure. Although it is preferred that the entire pan is imperforate, the broad practice of the invention permits some perforations in the pan at locations other than the location below the joints 20 of the overlying panels.

FIG. 2 shows three courses or rows of pans and panels mounted to the understructure. As shown therein at the overlap of upper and lower rows, there is only a double thickness of the panels, as opposed to the usual triple thickness.

It is to be understood that although the invention preferably involves detachably mounting the pans to the understructure and particularly to the tracks on the understructure, the invention may be practiced in other manners such as using mounting means which does not require tracks as later described, for example, with respect to FIGS. 11–13. For example, the invention could be practiced using a fastener or pan mounted directly to a deck. Additionally, it is within the broad practice of this invention to non-detachably mount the pans to the understructure.

Figure 3:
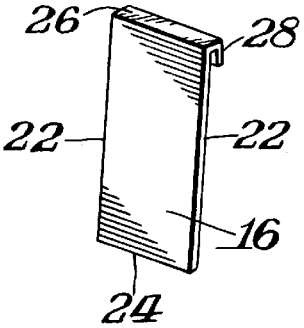
FIG. 3 is a perspective view of one embodiment of a pan in accordance with this invention.

FIG. 3 shows a pan 16 having the basic design in the practice of this invention. As shown therein, the pan 16 includes side edges 22 interconnected by a lower edge 24 and an upper edge 26. Upper edge 26 is bent to form a hook 28 which would be hooked over a track 14. The form of track shown in FIG. 2 is a Z-shaped track which has a base portion 30 mounted directly to the deck 12 and a fastener accommodating portion or wall 32 spaced from the base by an intermediate portion 34. A plurality of drain holes 36 (see FIGS. 1 and 17) may be located in the intermediate portion 34. The track, however, may take other forms such as being U-shaped or J-shaped. Hook 28 would slide over wall 32 of the track 14 to mount the panel 16 in place. In the basic form shown in FIG. 3 pan 16 is rectangularly shaped and completely imperforate.

This manner of mounting differs from the embodiments of the '596 patent in that all that is necessary is to provide a simple hooking action at the upper end of the pan 16. This hooking action is achieved by forming a hook structure which begins at the planar main surface of the pan 16 and then includes the downward bend 26 and inward bend 28 which extends below and directly under the main surface of the pan 16 and generally parallel to the pan so that the pan may be hooked over the track 14 as shown in FIG. 2. This avoids the necessity of having to position slots in side margins around a lower track as in the embodiments described in the '596 patent.

Figure 4:
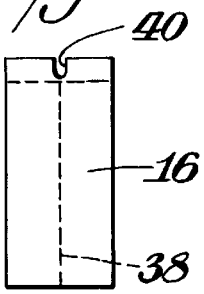
FIG. 4 is a front elevation view of an alternate embodiment of a pan in accordance with this invention.

FIG. 4 illustrates a modified form of pan 16 which includes an optional guideline 38 generally at the longitudinal center line of pan 16. Guideline 38 would be a visual guide to the roofer in knowing where to locate the side edge of a panel. The pan 16 of FIG. 4 may also include a notch or cut-out 40 which could further function as a visual guide. In addition, notch 40 accommodates the fastening hook 42 shown in FIG. 5 used for mounting the next upper row of panels 18.

Figure 5:
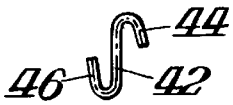
FIG. 5 is a side elevational view of a fastener for mounting a panel in accordance with this invention.
Figure 6:
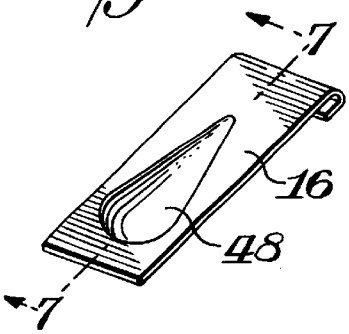
FIG. 6 is a perspective view of a modified form of pan in accordance with this invention.
Figure 7:
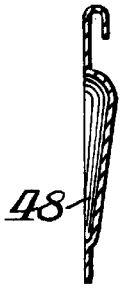
FIG. 7 is a cross-sectional view taken through FIG. 6 along the line 7—7.

FIGS. 1, 2 and 5 show the use of hook 42 which is a fastener of generally S-shape having a straight main portion and two hook ends 44,46. Hook end 44 would be mounted over wall 32 of track 14, while the lower hook 46 would act as a channel for receiving the lower edge of panel 18 disposed at the same track. The panels of one row are mounted staggered with respect to the panels in adjacent upper and lower rows so that the hook 42 of one row would be located at the joint 20 of its next upper and next lower row as illustrated in FIG. 1.

Fasteners in the form of S-hooks are known in the art in triple thickness, but not for use in a two thickness pan system and not as part of the pan. The invention, however, uses such fasteners which are also hooked over pans. This provides a particularly effective manner of mounting wherein the fasteners could be pre-mounted on the pans, such as each hook being in a notch 40. The pan/fastener unit would then be mounted over a track 14. Preferably hook or fastener 42 is about one-third the length of the length of pan 16.

The use of hooks such as hook 42 represents another significant difference from the embodiments described in the '596 patent. By using preformed hooks it is not necessary to perform any manipulative actions in situ such as the bending of tabs in the one embodiment of the '596 patent or the provision of upstanding locking fingers as in the other embodiment. Moreover, by avoiding the locking fingers, a plurality of the pans may be nested together during storage and transportation as later described with respect to FIG. 25.

It is to be understood that the type of guide structure shown in FIG. 4 is merely exemplary. Other forms of guide structure may also be used such as crinkles or raised or lowered portions on the upper surface of the pan and would limit lateral or vertical water movement including capillary action.

FIGS. 6–10 illustrate a further possible feature of this invention involving the provision of a water trap in a pan 16 at the location of a joint for the overlying panels. In the embodiment shown in FIGS. 6–7 the water trap is a tear-shaped depression 48 which is narrow and deep at the upper end of the depression and then generally widens and becomes shallow as the depression extends downwardly. Although depressions are illustrated, other forms of surface deviations such as elevations may also be used.

Figure 8:
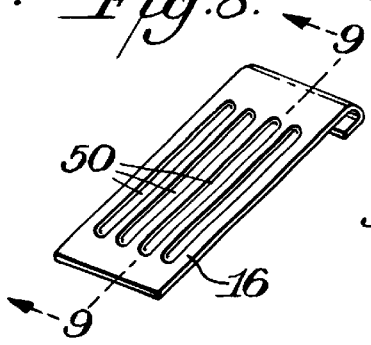
FIG. 8 is a view similar to FIG. 6 of yet another form of pan in accordance with this invention.
Figure 9:
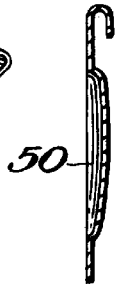
FIG. 9 is a cross-sectional view taken through FIG. 8 along the line 9—9.

FIGS. 8–9 show modified forms of water traps wherein a series of depressions 50 is provided in pan 16. Where straight parallel depressions 50 are used, the depressions (or elevations) could also function as guides for locating the edges of the overlying panels.

Figure 10:
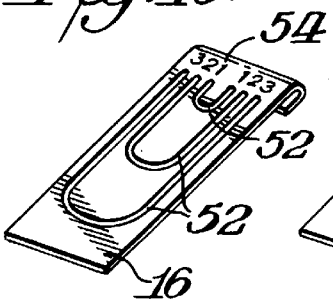
FIG. 10 is a perspective view of still yet another pan in accordance with this invention.

FIG. 10 illustrates yet another form of water trap or capillary break wherein the depressions 52 are a series of symmetrical parallel U-shaped depressions. The depressions 52 may also function as guidelines for the positioning of the edges of the panels. In addition or alternatively, indicia 54 in the form, for example, of numbers may be provided on the upper surface of pan 16, preferably at each depression to function as a guideline.

The arrangement of FIG. 10 has the advantages of providing a pan with reference markings for the positioning of the edges of the overlying panels. In addition, the U-shaped or smile-shaped indentations provide rigidity and inhibit water infiltration by restricting capillary action and wind driven rain and by directing the water to the centerline of the pan.

It is to be understood that while three different forms of depressions have been illustrated as water traps, the invention may be practiced with other forms of water traps. For example, the depressions may radiate upwardly and outwardly from the base of the pan toward the upper end of the pan. The water trap may be in the form of one or more surface deviations, such as troughs, pleats, grooves or other types of indentations or elevations.

As noted, while various figures illustrate the pan 16 to be hooked to the understructure by preferably being hooked to the offset or spaced wall of a track, the pans may be readily detachably mounted in other manners within the practice of this invention. Alternatively, the pans may be permanently secured to the tracks, deck or understructure.

Figure 11:
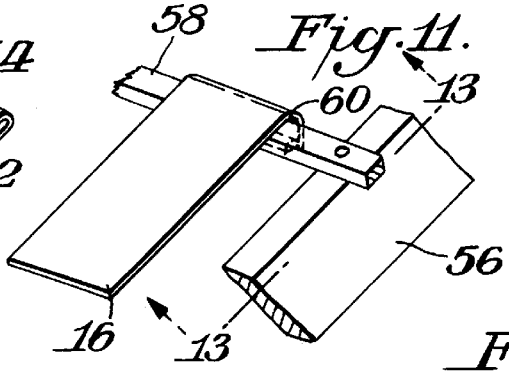
FIG. 11 is a perspective view showing mounting of a further form of pan to a batten in accordance with this invention.
Figure 12:
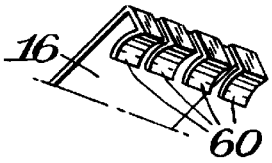
FIG. 12 is a fragmental rear perspective view of the pan shown in FIG. 11.
Figure 13:
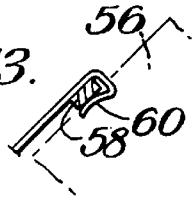
FIG. 13 is a cross-sectional view taken along the line 13—13 of FIG. 11.

FIGS. 11–13 show the detachable mounting of the pans 16 without the use of tracks. As shown therein the understructure does not include a deck, instead the pans are mounted by being hooked over battens or lathe strip 58 which are secured across the rafters 56. In the embodiment of FIGS. 11–13, a hook structure 60 is used at the end of pan 16. Hook structure 60 is optionally in the form of a plurality of spring fingers created by slotting the hook structure. The purpose of the spring fingers is to permit one or more of the fingers to be bent upwardly in line with the plane of the pan so as to allow certain pans to be slid over the rafter without interference from the hook 60.

The arrangement of FIGS. 11–13 would be particularly useful to conform to the conventional manner of attachment used in European style batten on rafter construction.

Figure 14:
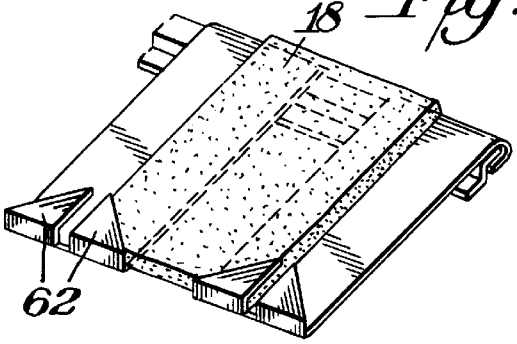
FIG. 14 is a perspective view of still yet another form of pan in accordance with this invention showing a panel mounted to two of such pans.
Figure 15:
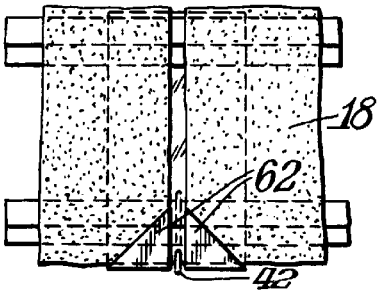
FIG. 15 is a front elevation view of the arrangement shown in FIG. 14.
Figure 15:
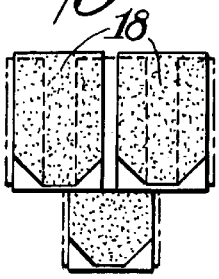

FIGS. 14–15A illustrate a further variation of this invention wherein each lower corner of a pan is provided with triangularly shaped channels or ears 62 for receiving a panel 18. This provides an alternative manner of mounting the panels without requiring fasteners, such as fasteners 42 shown in FIGS. 1–2. An advantage of this arrangement is to crop the corner of each panel in the sense that the ear 62 is visible on the roof. This gives the panels the decorative effect shown in FIG. 15A. If desired, fasteners 42 may be utilized in addition to the ears 62 as shown in FIG. 15 or in place of one or more ears. Alternatively, as later described, there can be a fixture under the pan which would also provide the security of a two track installation.

Figure 16:
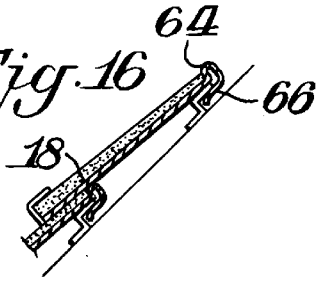
FIG. 16 is a side elevational view in cross-section showing a pan with a wind stop structure.

FIG. 16 shows a modified form of pan wherein the upper end is bent to create an upstanding wall 64 which is then bent around to form a hook 66. Wall 64 functions as a windstop which is particularly desirable to minimize any tendency of the wind to cause the panels to lift and blow moisture through the joints into the roof interior.

Figure 17:
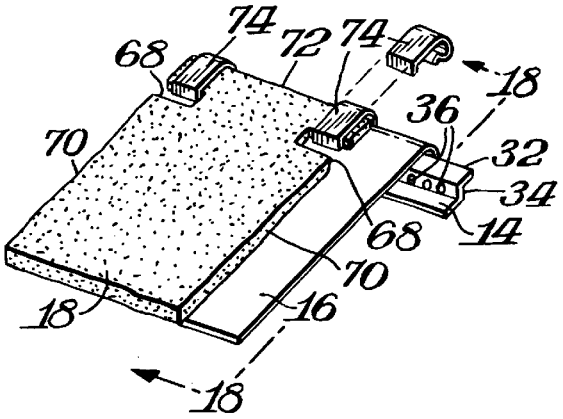
FIG. 17 is a perspective view showing the mounting of a panel to a pan and a track in accordance with one embodiment of this invention.
Figure 18:
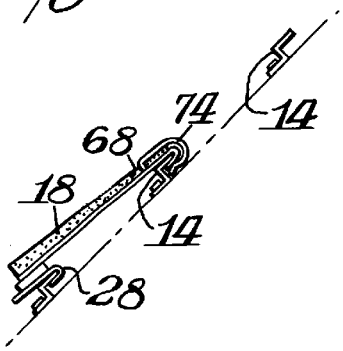
FIG. 18 is a cross-sectional view taken through FIG. 17 along the line 18—18.

The invention may be practiced wherein the panels 18 are provided with kerfs or slots as in my aforesaid patent applications. In such practice of the invention the kerfs are utilized as a means of mounting the panels. The kerfs also offer the possibility of hidden attachments, as later discussed. FIGS. 17–18, for example, illustrate a panel 18 provided with a pair of kerfs or slots 68 extending inwardly from each of the side edges 70 of the panel 18. The kerfs or slots 68 are located near the top edge 72. As illustrated in FIGS. 17–18 a spring clip type fastener 74 is provided for detachable engagement in each slot 68 and for resilient detachable engagement over the pan 16 and over the wall 32 of track 14. Fastener 74 may be of any suitable shape such as being generally R-shaped as disclosed in the above noted applications.

Figure 19:
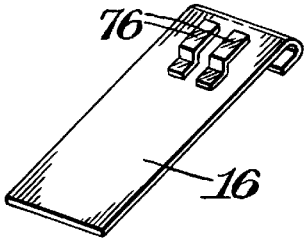
FIG. 19 is a perspective view of a modified form of pan for use with panels having kerfs or notches in accordance with this invention.

FIG. 19 shows a variation of a pan 16 having a pair of resilient hook members 76 which can be permanently mounted to the outer face of pan 16. Hook members 76 are upwardly facing for engagement of each hook member in a respective kerf or slot of one of a pair of side by side panels. If desired, the hook 76 may be of extended length to comprise a single hook member for engagement in two slots of the side by side panels.

Figure 20:
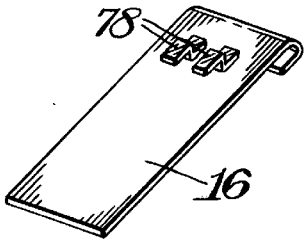
FIG. 20 is a view similar to FIG. 19 showing yet another form of pan.

FIG. 20 shows a pan 16 similar to that shown in FIG. 19 except that the resilient hook members 78 are downwardly facing for engagement in the slots of a panel.

Figure 21:
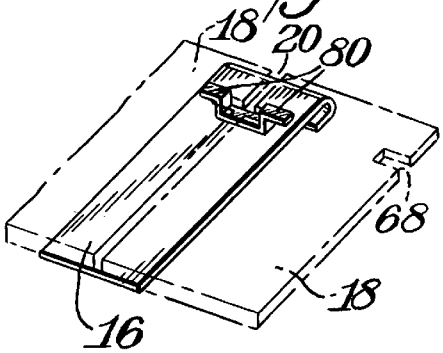
FIG. 21 is a view similar to FIGS. 19–20 showing still yet another form of pan.

FIG. 21 illustrates a further variation wherein the panel 16 has sidewardly disposed hook members 80 engaged in the slots 68 of side by side panels 18.

Figure 22:
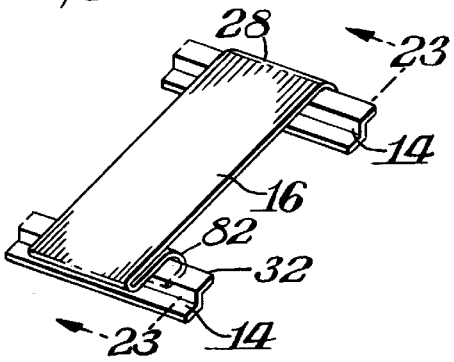
FIG. 22 is a perspective view showing a pan being hooked over two tracks in accordance with this invention.
Figure 23:
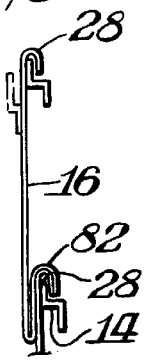
FIG. 23 is a cross-sectional view taken through FIG. 22 along the line 23—23.

FIGS. 22–23 show a variation of this invention wherein the pan 16 not only includes a hook 28 at its upper edge for upper track 14, but also includes a hook structure 82 at its lower edge for engagement with the wall 32 of lower track 14. In this variation of the invention the pan 16 is thus firmly mounted at both its upper and lower edges to provide a particularly stable mounting which is resistant, for example, to wind forces.

A variation to the arrangement shown in FIGS. 22–23 would be to mount the pan only at the lower edge by, for example providing only the hook structure 82.

Figure 24:
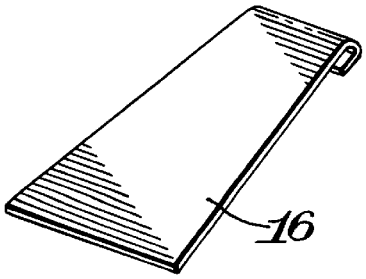
FIG. 24 is a perspective view showing a variation in the shape of a pan in accordance with this invention.

Although the various pans previously illustrated and described are of generally rectangular shape the invention may also be practiced wherein other shapes are utilized. FIG. 24, for example, shows a pan 16 of generally trapezoidal shape. What is important is that the pan is imperforate at the location of the joint 20 of adjacent sets of overlying panels so as to provide a barrier at the joint. The remaining structure of the pan is of less importance.

Figure 25:
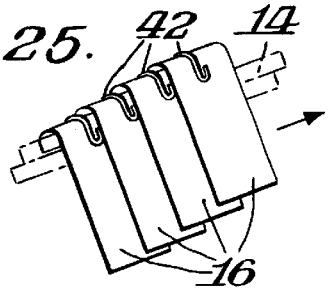
FIG. 25 is a perspective view showing a plurality of pans in accordance with this invention nested on a track.

FIG. 25 illustrates an advantageous practice of the invention wherein a plurality of pans 16 are in a nested condition prior to the mounting of the panels. Where the pans are of a structure similar to that in FIG. 3 the pans could completely overlap each other which minimizes space requirements during storage and shipping. Where the pans are in the form shown in FIG. 4, which is the form illustrated in FIG. 25, the invention may be practiced by mounting each hook 42 in its notch and nesting the pan/hook combinations in the partially overlapped manner shown in FIG. 25. The group of nested pans/hooks could then be mounted as a unit on a track 14 and the roofer would simply slide the pans apart using the track as a guide until the pans are properly spaced with respect to each other. The spaced pans are then in a condition to receive the panels in the hooks 42. This arrangement would greatly shorten the time necessary for mounting the components during the roofing installation. A similar procedure would be used where the hooks are not pre-mounted in that a nested set of pans could be mounted on a unit on a track and then spread apart.

The nested feature of this invention could also be utilized by having hook structure permanently secured to the pan through the use of integral hooks or separate hooks then permanently attached to the pan.

Figure 26:
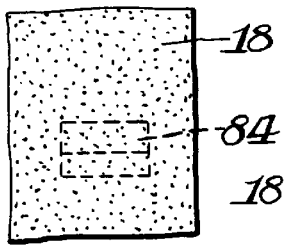
FIG. 26 is a top plan view of a panel in accordance with a practice of this invention.
Figure 27:
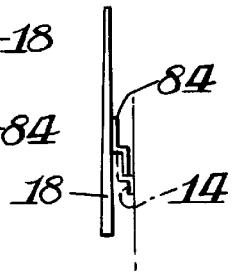
FIG. 27 is a side elevational view of the panel shown in FIG. 26 mounted on a track.

FIGS. 26–27 illustrate a practice of the invention wherein the panel 18 itself is provided with a permanently secured hook structure 84 for engagement directly on the track 14. The hook structure could be an integral clip where a synthetically made panel is used. Where a natural slate panel is used, the clip could be permanently adhered to the undersurface of the panel by any suitable adhesive or adhering means.

Figure 28:
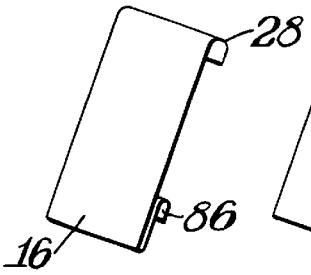
FIGS. 28–30 are perspective views of modified forms of pans in accordance with additional practices of this invention.

FIGS. 22–23 illustrate a practice of the invention wherein the pan 16 is attached to a pair of tracks by the upper hook structure 28 and by a lower hook structure 82 formed by bending the lower end of the pan into the hook structure. FIG. 28 illustrates a variation where a second hook structure 86 is provided spaced upwardly from the lower edge of the panel 16 rather than being formed by the lower edge itself.

The invention may be practiced by incorporating stiffeners such as elongated ribs on the pans which would not only strengthen the pan but would also permit the use of thinner panels. Such stiffeners could also function as guides for alignment purpose and for water breaks as well as being hooked shaped to provide for track attachment.

The hook structure 86 of FIG. 28 may be in the form of a stiffener. By locating the stiffener or hook 86 at generally the longitudinal center of the panel the stiffener may also act as a guide similar to guide line 38 in FIG. 4.

Figure 29:
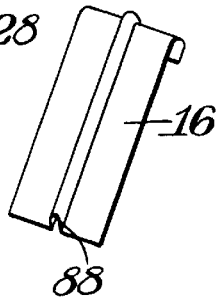

FIG. 29 shows an alternative stiffener in the form of a rib 88 extending longitudinally the entire length of the pan 16. Alternatively, rib 88 may extend only over a portion of the length of pan 16. Preferably, rib 88 is centrally located to function as an alignment guide. The invention, however, may be practiced in any suitable manner by one or more such stiffeners of any suitable length arranged in locations other than or as well as the longitudinal center line of pan 16.

Figure 30:
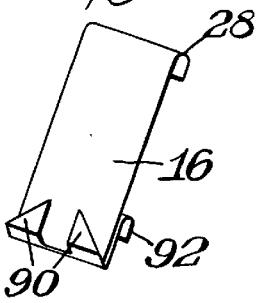

FIG. 30 shows a variation of pan 16 which incorporates some of the features of FIG. 14 in that ears 90 preformed at the bottom of the pan 16 remote from the hook end 28. The ears 90 may be part of a separate structure which has its lower surface bent to form a hook end 92 with the pan 16 being disposed between the ears 90 and hook end 92. Alternatively, the ears 90 could be integral with pan 16 and the hook 92 also permanently secured to pan 16 by being integral or being an initially separate member permanently secured to the pan.

Figure 31:
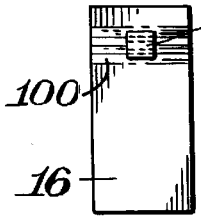
FIG. 31 is a top plan view of a panel having a modified clip assembly in accordance with still yet another form of this invention.
Figure 32:
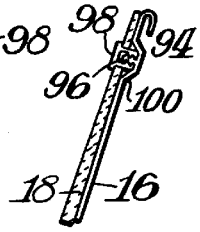
FIG. 32 is a side elevational view of the panel and clip assembly mounted to a pan in accordance with the embodiment of FIG. 31.

FIGS. 31–32 show a further practice of the invention wherein the panel 18 is secured to the pan 16 by means of a fastener assembly which includes a male member 94 and a female receptacle member 96. Male member 94 would be permanently secured to pan 16 and would be located in alignment with a hole or kerf in panel 18. The female receptacle member 96 would comprise a separate clip member which would be inserted through the hole for engagement by the male member 94. Female receptacle member 96 includes an enlarged head 98 extending outwardly from the hole in the panel 18 so as to clamp the panel to the pan by engagement of the male and female members. An advantage of the arrangement in FIGS. 31–32 is that it permits the components to be extruded for mass production purposes and thereby reduce costs. Where the male and female members are of extended length it would be preferable to form through holes for permitting the passage of water so as to prevent water accumulation at the fastener. The same type of fastening arrangement could be used for mounting the pan to the track. As shown in FIG. 32 pan 16 has a depressed portion 100 at which male member 94 is located to permit a surface to surface contact of the panel 18 against pan 16 in areas other than where the fastener is located.

Where fastening arrangements are used in conjunction with panels having kerfs it is possible to dispose substantially all of the fastening structure at the undersurface of the panel by utilizing the kerfs for access to the undersurface and thereby result in a hidden clip or fastening system.

Figure 33:
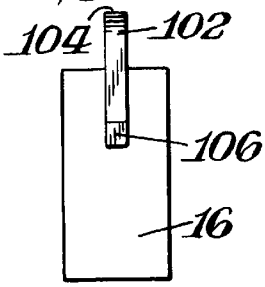
FIG. 33 is a top plan view of yet another modified pan in accordance with this invention.
Figure 34:
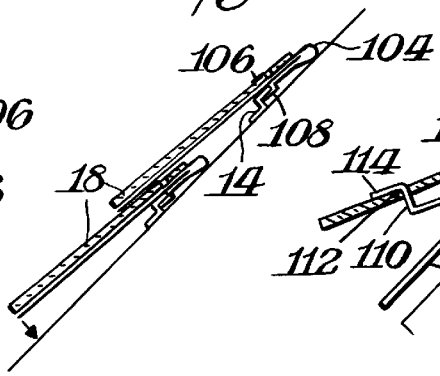
FIG. 34 is a side elevational view in section showing the pans of FIG. 33 mounted on tracks.

FIG. 33 illustrates a pan 16 having a fastener 102 which extends outwardly beyond the upper edge of pan 16. Fastener 102 is preferably a spring fastener with a curved head 104 as shown in FIG. 34. Fastener 102 also includes an offset spring clamping section 106 at its free end. FIG. 34 illustrates how a panel 18 would be mounted by inserting the hook end 106 over the panel at a kerf located in the panel so that the remaining portion of fastener 102 is hidden by the panel. The curved end 104 would engage against the understructure or deck to resist any lifting at the lower or butt end of the panel while the fastener 102 still provides the desired springiness.

In the embodiments of FIGS. 33–34 fastener 102 could be made sufficiently wide so as to accommodate two side by side panels. Alternatively, a narrower fastener would be used for only a single panel.

In the embodiment of FIGS. 33–34 the pan 16 would also include some form of hook structure 108 in any of the forms previously described for engagement with the track 14.

In the embodiment of FIGS. 33–34 the fastener 102 could be a member separate from the pan 16 or could be integral with the pan itself. The spring end 104 functions as a pivot member for driving the panel's lower edge toward the roof deck.

Figure 35:
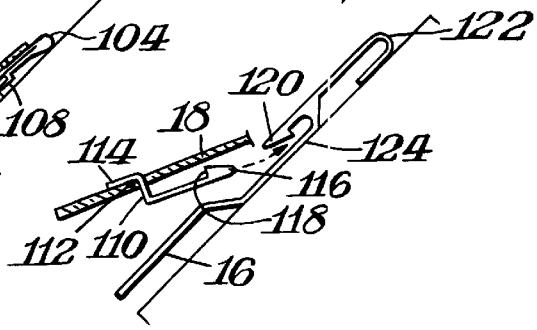
FIG. 35 is an exploded side elevational view showing the assembly of a roofing panel in a pan in still yet another form of this invention.

FIG. 35 shows an arrangement which utilizes a substantially hidden clip for securing the panel to the track while avoiding accumulation of water. As shown therein clip 110 would be inserted through the kerf 112 in panel 18 so that only a small portion 114 of the Z-shaped clip is visible. The opposite end of clip 110 includes a ramp 116 which terminates in a stop wall 118 for engagement with similar structure 120 formed on pan 16. Pan 16 could also include an integral pivot end 122 similar to head 104 of fastener 102. FIG. 35 shows how the clip 110 and panel 18 are pre-assembled and then mounted to pan 16 by a sliding action wherein the ramp 116 passes under locking structure 120 of pan 16 until the stop wall 118 is moved beyond the locking structure. Due to the springy nature of one or both of the locking end 120 and ramp 116 of clip 110 it is possible to engage the clip and pan by using a springy cam action until the engagement is made.

The arrangement of FIG. 35 includes incorporating an indented portion 124 in pan 16 for accommodating the clip 110 while still permitting a surface to surface contact between the panel and pan. By avoiding locking elements similar to male member 94 and female receptacle 96 of FIGS. 31–32 there is no structure in the arrangement of FIG. 35 which might collect water. A further advantage of the arrangement shown in FIG. 35 is that the components such as the locking structure on pan 16 lends itself to being extruded in the formation of the pan.

As can be appreciated the various embodiments of this invention provide numerous alternatives for a roofing or siding assembly which may be easily installed while being highly effective upon installation. Various components in the assembly serve multiple functions. For example, FIG. 1 shows the location of the hooks 42 in such a manner as to receive a panel 18 in each hook. The location, however, also results in a hook associated with the upper tracks being on each side of a panel 18. These abutting hooks act as stops to prevent any rotation of the panels. Accordingly, as is apparent from FIG. 1 a panel is in effect engaged by or against a series of three hooks at three spaced locations to not only initially securely mount the panel in place but also to assure that the panel remains mounted in place without any rotation or sliding movement of the panel.

Given the suggestions in the various practices of the invention other practices should also be apparent. For example, the invention might be practiced by utilizing an enlarged combined pan and track assembly on which a plurality of panels would be mounted. Although various practices of the invention refer to the use of spring clips, where, for example, simply a hooking function is necessary the clips need not be made of a resilient or springy material.

Structure similar to pans (apart from the '596 patent) have previously been used wherein such structure has been rigidly fixed to the roof deck or understructure by fasteners such as nails. In the preferred practice of this invention, however, the pans are readily attached and detachable by being hooked to the understructure. It is to be understood that the invention could be practiced by incorporating previously described features such as guide structure, water traps, etc., on prior art type rigid, permanently (i.e. not readily detachable) pans.

Among the distinctive features of the invention are the provision of pans hooked on tracks and the provision of pans having fasteners, particularly detachable fasteners for the mounting of panels. Various embodiments of the invention also provide the desired ventilation and compliance while providing a secure mounting of the butt end of the panel during the roofing or siding installation.

As previously noted the various embodiments of the present invention differ from the embodiments of the '596 patent in a number of respects such as the manner in which the pan is secured to the tracks and the manner in which the panels are mounted. A further difference is that in the embodiments in the '596 patent the strip rests on the lower flange of the track against the intermediate flange. This could create a gap between the upper edge of the strip and the intermediate edge of the track where the tracks are not properly positioned with respect to each other. With the present invention the pan is mounted over and against the upper edge of the track between the panel and the track. With the '596 patent embodiments if thin shingles are used there may be a gap between the overlying shingle and the strip because of the manner of placement of the strip on the track which could result in water problems or in problems relating to the wind causing an uplift. The possibility of gaps is minimized with the present invention.

The embodiments in the '596 patent application are also likely to be more expensive than the present invention because of the requirement for the use of more metal in that the strip must also have the bent side margins and tabs, for example, for mounting purposes. The bent side margins in the '496 patent embodiments also result in a thicker strip which is more rigid and thus lacks the degree of flexibility of the pans in the present invention. This could be important in inhibiting lateral air flow where the strips or pans are mounted on a deck.

The use of tabs or locking fingers as in the '596 patent embodiments would result in fasteners which are more noticeable than the manner of panel mounting as in the present invention. Moreover, in the '496 patent embodiment which uses tabs at its lower end it is necessary that the tabs be made of the same material as the strips and also that the tabs be sufficiently thin to permit the tabs to be crimped over the panels in situ. By definition, the tabs must be readily bent by hand, and thus could present inadequate strength under load from, for example, sliding snow or ice. The present invention, however, which may utilize separate fasteners or hooks, such as hook 42, is not restricted to thin materials for the fasteners. It is also expected that the use of a single hook which is centered would be more preferable in appearance than a tab at the end or corner of a panel as in the first '596 patent embodiment. Further, the first '596 patent embodiment which requires the tabs to be formed in situ would be more time consuming and would run the risk of possible fatigue which would limit the number of times that the strip could be used since multiple uses might result in the tabs breaking off the strip. In contrast, the use of detachable fasteners such as hooks 42 with the present invention better lends itself for repair and replacement and does not inhibit further multiple uses of the pan. The ability to nest or stack the pans during storage is achieved in part because the side edges of the pan and the bottom edge of the pan are coplanar with the central portion of the pan. In contrast with both embodiments of the '596 patent application it is necessary to have downturned side edges in order to provide the slots 16. This is true even in the embodiment of FIGS. 5–6 because the L-shaped bracket alone would be insufficient to securely mount the strip in that there is not adequate contact with the batten. In contrast, the hook structure with the present invention utilizes three different surfaces which in effect wrap around the upper edge of the track.

Figure 36:
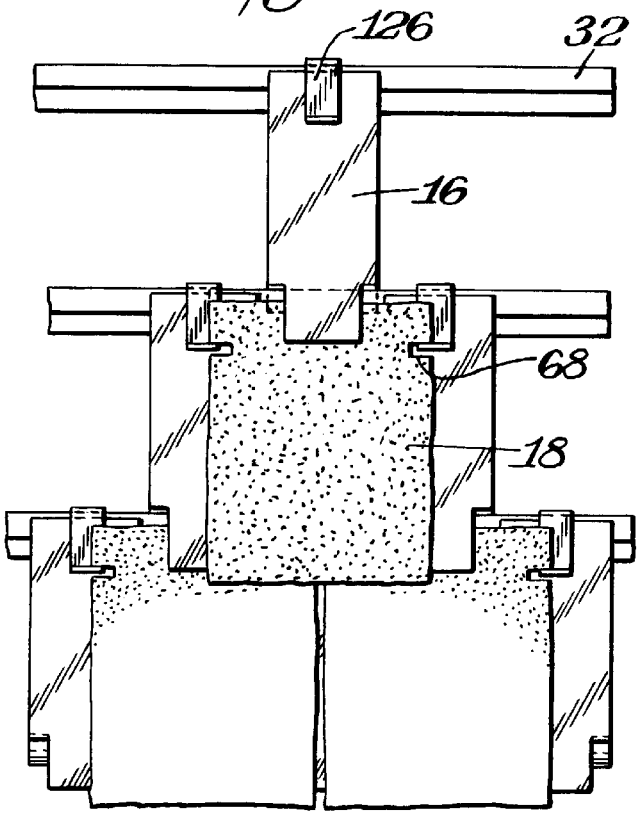
FIG. 36 is a top plan view showing a portion of yet another form of roofing assembly in accordance with this invention.
Figure 37:
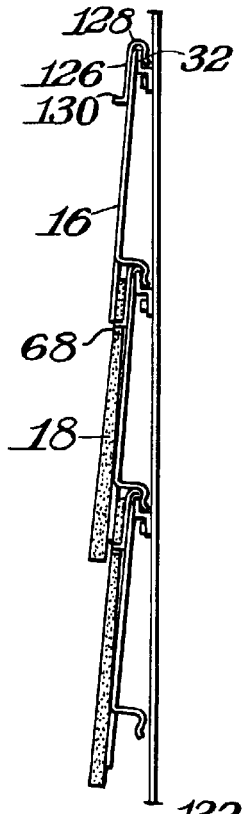
FIG. 37 is a side elevational view of the assembly shown in FIG. 36.

FIGS. 36–37, for example, show an assembly wherein the hook structure at the upper end of pan 16 is achieved by means of a separate hook member 126 which resiliently clamps the upper end of the pan 16 against the wall 32 of the track 14. In this regard, a hook formation 128 is resiliently formed at one end of the hook structure 126 while the other end which is disposed against the outer surface of pan 16 has an outward extension 130 which may be perpendicular to the pan as shown in FIG. 37. The outward extension would be inserted in a kerf 68 of the panel 18, but ends within kerf 68 as clearly shown in FIG. 37, thus, the hook structure 126 does not extend beyond the outer surface of panel 18. The overriding pan from one row would keep the panel or slate in the lower row from being plucked off by the wind, particularly where there is engagement of the overriding pan with the track for the lower row, such as provided for by clips 136 later described with respect to FIGS. 40–41. Such arrangement is effective in securely mounting the panels.

Figure 38:
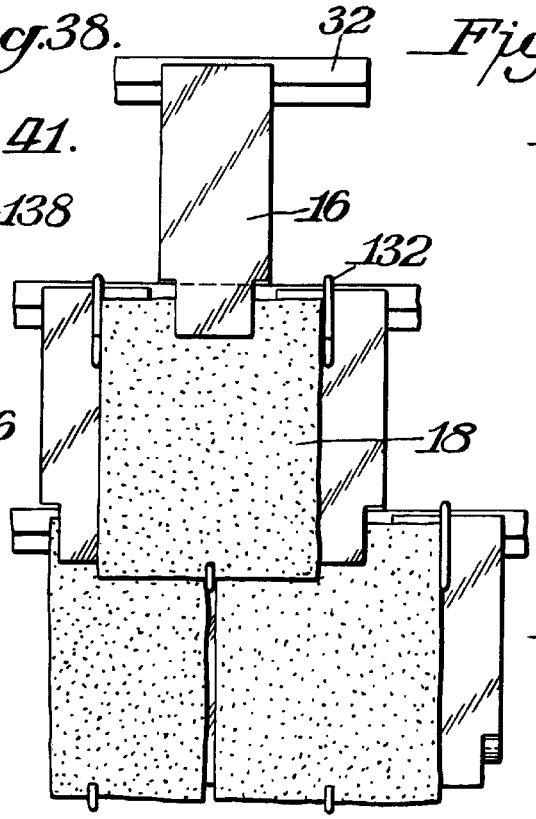
FIG. 38 is a top plan view of yet another roofing assembly in accordance with this invention.
Figure 39:
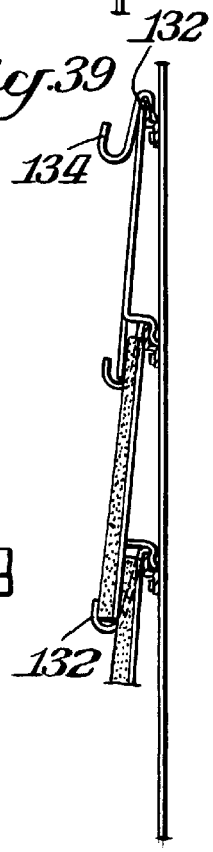
FIG. 39 is a side elevational view of the roofing assembly shown in FIG. 38.

FIGS. 38–39 show an arrangement generally similar to that of FIGS. 36–37, except that the hook member 132 includes a hook shaped lower end 134 for mounting the lower edge of a panel 18 where the panels do not have side kerfs or slots.

Figures 40, 41:
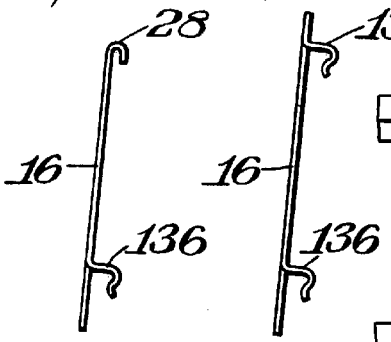
FIGS. 40–41 are side elevational views of alternative forms of pans in accordance with this invention.

FIG. 40 shows a variation of pan structure which is utilized in the embodiments of FIGS. 36–37 and FIGS. 38–39. In this variation the pan includes a punched out area bent to form a hook structure 136 which may be of generally R shape and which would mount around the wall 32 of the lower track. Thus, the pan 16 would be secured to a pair of tracks by the hook structure 28 and the hook structure 136.

FIG. 41 shows a pan similar to that of FIG. 40 except that the upper hook structure 138 is formed on the rear side of pan 16 below its upper edge rather than being the upper edge itself.

As noted above the utilization of securing means, such as the resilient clip 136 at the lower portion of the pan 16 provides the advantage of securely mounting the pan to an upper and a lower track which in turn adds to the secure mounting of the panel or slate and is particularly effective under wind conditions. Although the '596 patent illustrates in its FIG. 6 a pan type structure which would be located at two tracks, the present invention differs by providing a resilient and thus compliant manner of mounting the pan.

It is an express aim of this invention to provide a compliant attachment, both of the pan and the panel. Such compliance reduces strain on rigid tiles or panels, reduces breakage and accommodates building settling and variable loading from, for example, foot traffic and snow accumulation. The compliant attachment could be accomplished by hook structure at both the top and bottom of the pan or at either the top or bottom alone.

The various prior embodiments are particularly adapted for mounting the pans to tracks. The invention may also be practiced without the use of added tracks particularly where a wooden understructure is used such as from a wooden deck or wooden battens spaced from each other in a conventional manner. In one sense the battens may function as the tracks. Alternatively the pan could be anchored directly to the wooden understructure without a hooking action and thus without the need for a track. It is to be understood that while reference is made to an understructure made of wood, other materials might be used where the pan is mounted directly to such other materials.

Figure 42:
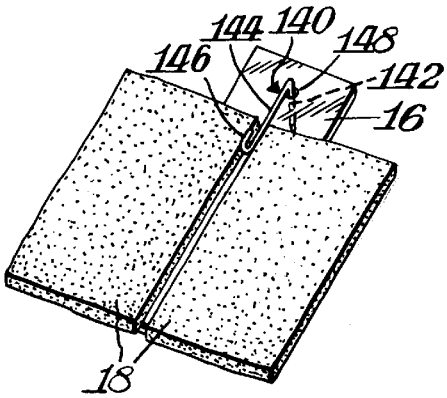
FIG. 42 is a perspective view of a portion of a modified form of an assembly in accordance with this invention.

FIG. 42 illustrates one version of the invention wherein the pan is anchored directly to an understructure without the use of tracks. As shown therein a nail hook 140 is utilized for such mounting. Nail hooks are known and include a pointed end such as end 142 and an offset end such as end 144. In this practice of the invention, the offset end 144 terminates in a hook structure 146. Pan 16 would have a hole formed therethrough either by being preformed or by the pointed end 142 forming the hole 148. Thus, pan 16 would be mounted by inserting pointed end 142 of nail hook 140 through hole 148 with pointed end 142 then being nailed directly into the understructure. A panel 18 would be mounted by being located in the hook structure 146. FIG. 42 illustrates the panels that would be mounted to lower pans (not shown).

Figure 43:
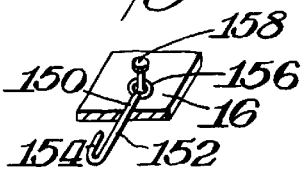
FIG. 43 is a view similar to FIG. 42 of an alternative form of this invention.

FIG. 43 illustrates a variation of the embodiment shown in FIG. 42 wherein the pan mounting device 150 is of generally J-shape having an elongated intermediate portion 152 terminating at its lower end in a hook structure 154. The upper end has an enlarged portion or loop 156 through which a fastener 158 such as a nail or screw would be inserted. Enlarged portion 156 may be of circular shape with an annular opening to facilitate the insertion of the fastener 158 through pan 16 and then into anchoring engagement with the understructure.

Figure 44:
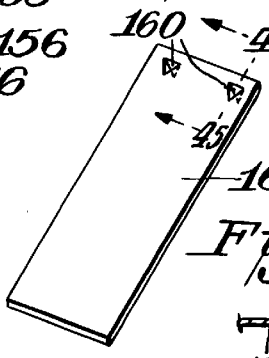
FIG. 44 is a perspective view of a pan in accordance with still yet another form of this invention.
Figure 45:
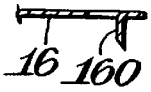
FIG. 45 is a cross-sectional view taken through FIG. 44 along the line 45—45.

FIGS. 44–45 illustrate a further variation of a pan 16 which is used without requiring tracks. As shown therein integral tabs 160 are formed by punching or bending out portions of pan 16 so that the tabs 160 are then directly nailable into the understructure. In the version shown in FIG. 44 a separate hook member such as the S-hook 42 shown in FIG. 5 would be mounted over the pan 16 for mounting the panels.

Figure 46:
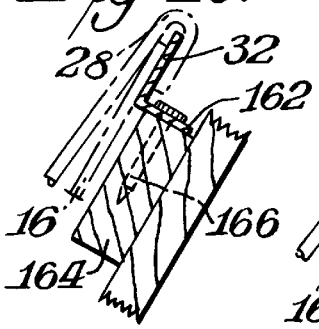
FIGS. 46–47 are side elevational views partly in section of portions of further roofing assemblies in accordance with this invention.

FIG. 46 shows another variation of mounting a pan 16 without tracks. As shown therein an L-shaped bracket (or series of brackets) or angle iron 162 is used instead of a track. Bracket or angle iron 162 would be disposed directly against a batten 164. A nail 166 or other fastener would be utilized to mount the bracket 162 to the batten 164 by passing the nail 166 through the bracket and into the batten. The nail 166 may pass through a preformed hole in flange 162 or the nail may create the hole.

As shown in FIG. 46 the bracket 162 would thus have an upwardly extending leg 32 which functions in the same manner as the fastener accommodating wall 32 of the previously described tracks 14.

Figure 47:
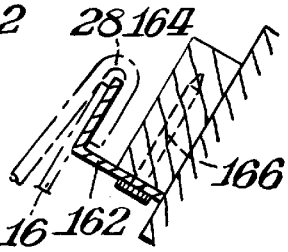

FIG. 47 illustrates a variation to the mounting arrangement of FIG. 46 in that the bracket 162 in FIG. 46 is mounted to the top of the batten while FIG. 47 shows the mounting to be at the bottom of the batten. A further alternative would be to mount the bracket 162 directly to a solid wooden understructure by rotating the bracket 90° so that one leg would be mounted against the understructure and the other leg would extend outwardly in a generally horizontal direction. Preferably, however, a vertical wall should be used for receiving the hook structure of the pan. Thus, the invention may also be practiced by using U or J-shaped brackets mounted directly against a wood deck.

Instead of having an L-shaped bracket or angle iron 162, as in FIGS. 46–47, a sheet or plate may be attached directly to the side of a batton 164 and extend partially above the batton and function as leg 32 for having the hook 28 mounted around the extended portion. The sheet may also include a small offset through which a fastener may mount the sheet to the batton.

Figure 48:
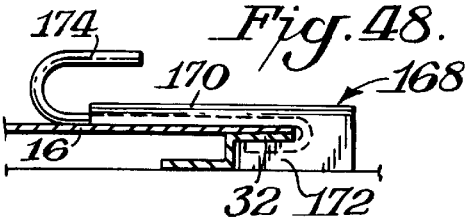
FIG. 48 is a side elevational views partly in section showing an alternative manner of mounting a pan in accordance with other aspects of this invention.

FIG. 48 illustrates a further variation of the invention which may be used where separate hook members are utilized in the roof mounting assembly, such as the hook member 42 shown in FIG. 5. In particular, the embodiment of FIG. 48 is used where such hook member is relatively large. In this regard, it is desired to make the hook member of material that will have sufficient resiliency to effectively mount the pan such as to a track or to a batten, while the other end has sufficient resiliency for snugly holding a panel. Under such circumstances where a relatively long hook member is used, it would be desirable to provide some means of reinforcing the hook member so as to assure an effective mounting. FIG. 48 shows such an arrangement. As shown therein a guard 168 is provided which essentially is made by starting with a flat generally T-shaped plate member having downward extensions at the ends of the T. The plate would then be bent into a channel shape. In use the guard 168 bent to its channel shape would be mounted over a hook completely covering the hook and leaving only the hook structure 174 exposed. The unit comprising the hook and the guard would then be mounted over the pan 16 and wall 32 of the track, much the same as the hook 42 would be mounted. The end U-shaped structure 172 would be disposed around the wall 32 and pan 16.

Figure 49:
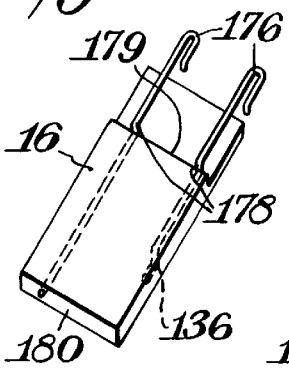
FIGS. 49–51 are perspective views of still yet other forms of pans in accordance with this invention.

FIG. 49 shows a further variation of the invention wherein the hook structure at the upper end of a pan 16 is formed from wire members 176. In this version two such hook members 176 are provided, one at each side of pan 16. The hook members 176 may be of any suitable construction and may be mounted to pan 16 in any suitable manner. In the embodiment illustrated pan 16 could be made of a plastic material with the wire members 176 integrally formed therein during the extrusion of the pan. The wires 176 could be covered by in effect a layer of the plastic pan material with only the hook portions exposed. In order to provide greater compliance portions of the plastic layer may be stripped or removed so as to expose an additional length of each wire. FIG. 49, for example, indicates a score line 179 to be provided to facilitate the stripping of the upper surface or outer layer of the pan with the exposed portion of wires 176 terminating at locations 178. This manner of exposing the wires might be somewhat analogous to the stripping of insulation from electrical wires so that a controlled amount of electrical wire is exposed.

If desired, the wires 176 could extend the entire length of pan 16 terminating at its bottom edge 180 as shown in the left side of FIG. 49. Alternatively the wires 178 could extend through the back of pan 16 and form the hook structure 136 shown in the right side of FIG. 49. Where the wires extend the length of the pan, it is preferred to include hook structure on the back of the pan. In the embodiment shown in FIG. 49 the panel would be secured by mounting a separate hook member such as hook 42 of FIG. 5.

Figure 50:
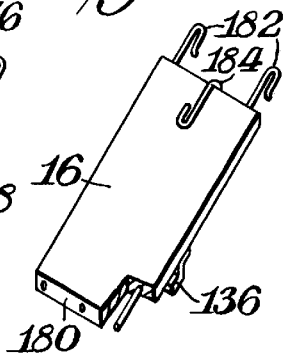

FIG. 50 illustrates a variation wherein three wires or hook members 182,182 and 184 are provided on pan 16. As shown therein each hook member is in the form of a wire integrally formed in the pan 16 similar to the version shown in FIG. 49. The intermediate hook member 184 could function for holding the panels. If desired the auxiliary hook structure 136 may be utilized for securement to a lower track.

In the versions of FIGS. 49 and 50 the wires are used which are of sufficient strength to hold their shape and yet have enough resiliency to function as spring clips at their hook ends.

Figure 51:
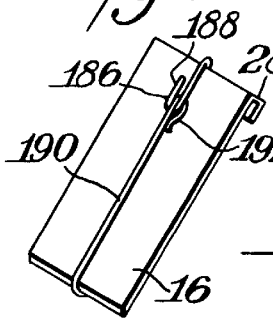

FIG. 51 illustrates a variation of the invention which includes alternative structure for mounting a hook on the pan 16 to secure a panel in place. As shown therein the pan itself would be mounted to a track or understructure in any suitable manner, such as by the hook end 28. A panel holding hook 186 is formed by having a hook member extend as a complete loop longitudinally around pan 16 so as to result, however, in a hook structure 188 located centrally in generally the upper portion of pan 16 for receiving a panel.

Figure 51A:
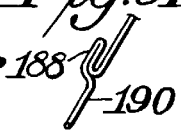
FIGS. 51A and 51B are perspective views of modifications to the form of pan shown in FIG. 51.
Figure 51B:
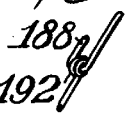

The hook structure 188 may be formed in any suitable manner. FIG. 51 illustrates hook structure wherein a single wire 190 is used having two free ends. The wire is wrapped around pan 16 and the free ends are fastened together by forming a hook 192 at one end which fits around the hook 188 at the other end to lock the two ends together. FIG. 51A shows an alternative wherein a continuous wire 190 is used which has a crimp forming the hook 186. FIG. 51B shows yet another version wherein the end 192 is twisted around the lower portion of hook end 188.

Figure 52:
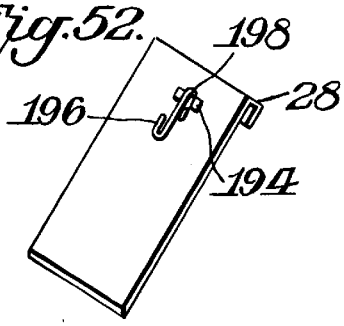
FIG. 52 is a perspective view of still yet another pan in accordance with this invention.

FIG. 52 shows yet another alternative form of the invention wherein a bracket 194 is fastened to the exposed surface of pan 16 into which a spring clip 196 would be mounted in a bulged out central portion 198 of the bracket 194. The spring clip 196 would be used for mounting the panel.

Figure 53:
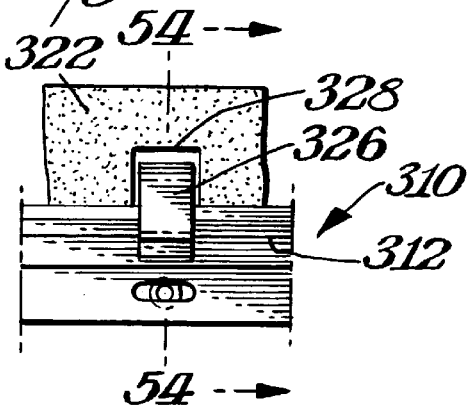
FIG. 53 is a bottom plan view of a roofing assembly in accordance with this invention.
Figure 54:
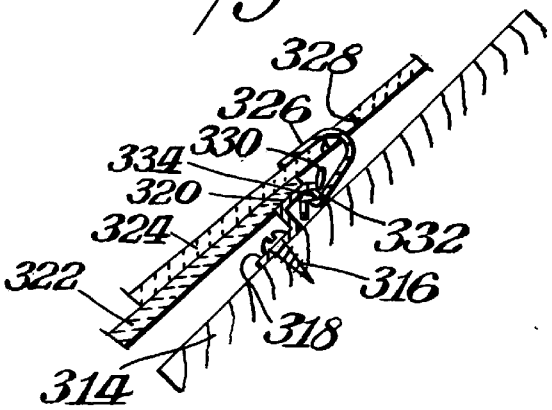
FIG. 54 is a cross-sectional view taken through FIG. 53 along the line 54—54.

FIGS. 53–54 show one form of variation which is intended to assure a firm mounting of the clip or fastener to the track. As shown in FIGS. 53–54, the mounting assembly 310 includes a track 312 which is, for example, of Z-shape of U-shape or J-shape and which is secured to the understructure such as the roof deck 314 of a roof or wall. The mounting may be accomplished by a screw 316 extending through a hole in the base portion 318 of track 312 as shown in FIGS. 53–54. Track 312 also includes a generally parallel spaced offset wall 320 against which a panel 322 would be mounted. The panel 322 underlies a further panel 324 as best shown in FIG. 54. Panels 322,324 are mounted to track 312 by means of a spring fastener 326 which may extend through slots or kerfs 328 in the upper panel 324 and thereby causes the upper panel to press against the head portion of underlying panel 322. This general type of structure is described in my aforenoted U.S. patents.

As best shown in FIG. 54, the fastener accommodating wall 320 of track 312 terminates in a barb or outwardly bent edge 330 which also creates a slight shoulder 332. Fastener 326 has a similarly shaped barb or hook portion 334 which engages against the shoulder 332, thus minimizing any accidental dislodgement of the fastener 326 from the track 312.

Figure 55:
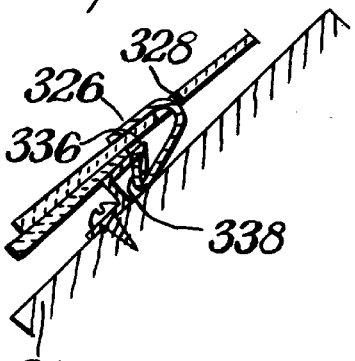
FIG. 55 is a right side elevational view of a modified form of roofing assembly in accordance with this invention.

FIG. 55 illustrates a variation wherein the offset wall 320 terminates in a downwardly extending edge 336. Fastener 326 terminates in a bent edge 338 disposed against or hooked under bent edge 336.

Figure 57:
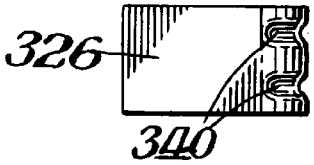
FIG. 57 is a top plan view of the fastener shown in FIG. 56.
Figure 56:
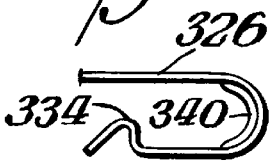
FIG. 56 is a side elevational view of a clip or fastener in accordance with this invention.

FIGS. 56–57 show a variation wherein the clip 326 is provided with recessed stiffening structure 340.

Figure 59:
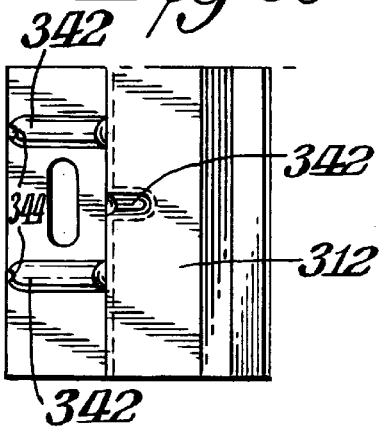
FIG. 59 is a top plan view of the track shown in FIG. 58.
Figure 58:
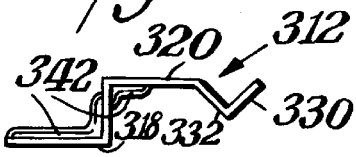
FIG. 58 is an end elevational view of a further form of track in accordance with this invention.

FIGS. 58–59 show a further variation wherein the track 312 includes a plurality of recessed stiffeners 342. If desired weep holes 344 may be provided in stiffeners 342.

Figure 60:
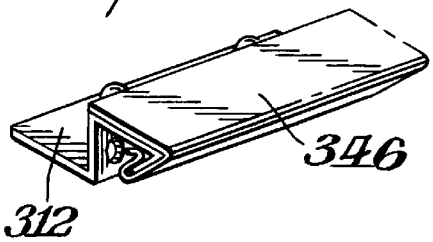
FIG. 60 is a perspective view of yet another form of track in accordance with this invention.

FIG. 60 shows a variation wherein the track 312 is provided with a detachable sheath 346 detachably mounted on the panel contacting surface of offset wall 320. Sheath 346 functions as a barrier or protector to prevent, for example, the alkalis from cement based shingles from attacking an aluminum track. Sheath 346 could be detachably mounted in any manner such as being stretched over wall 320 when desired to replace a worn sheath. The sheath could then be pealed and a new sheath inserted.

Figure 61:
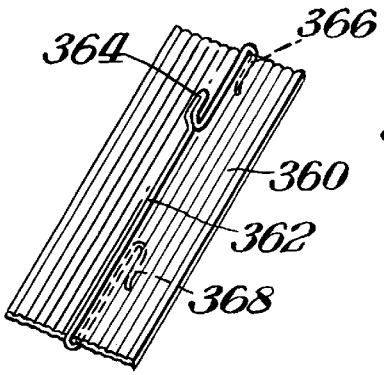
FIG. 61 is a perspective view showing a variation of the pan techniques.

FIGS. 61–64 techniques shown in FIGS. 51, 51A and 51B, where the pan is provided with a hook structure formed from a single wire wrapped around the pan. FIGS. 61–64 show variations wherein the pan 360 has a wire 362 which wraps completely around the front surface of the pan but only partially around the rear surface of the pan. As shown in FIG. 61 pan 360 has an irregular surface over at least part of the upper and lower edges to provide a guide or seat for the wire 362. For example, as illustrated in FIG. 61 the pan is made corrugated to provide adjustability in the precise location of the wire 362. In the embodiment shown in FIG. 61 the wire is bent to form a hook 364 into which a panel would be inserted. See FIG. 64. Each end of the wire also terminates in a downwardly directed hook structure 66,68.

Figure 62:
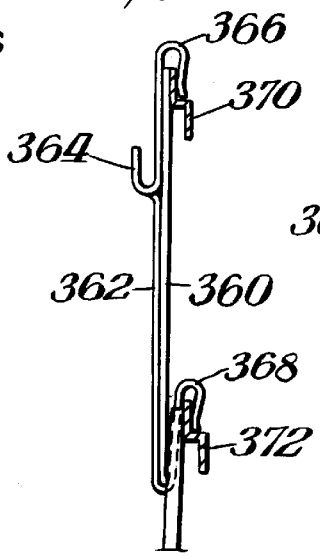
FIGS. 62–64 are side elevational views partly in section of further variations thereof for the pan techniques.

FIG. 62 illustrates one manner of mounting by use of the wire 362. As shown in FIG. 62 the upper hook 366 would be mounted around track 370 while the lower hook 368 would be mounted around track 372.

Figure 63:
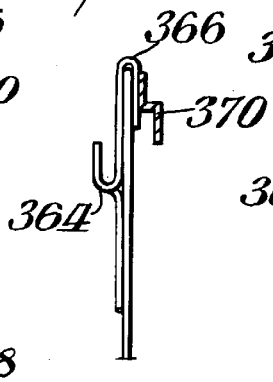

FIG. 63 illustrates an alternative means of mounting wherein the upper hook 366 is disposed between the pan 60 and the track 370. The upper end of pan 360 may, if desired, be hooked to track 370 by other fastening means including separate fastening members of clips or U-shaped extensions of the pan itself.

Figure 64:
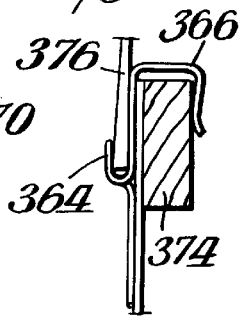

FIG. 64 illustrates a variation wherein the hook 366 would be mounted around a structural part of the undersurface, such as the deck 374. Similarly, the lower hook 368 would also be mounted around a portion of the deck. FIG. 64 also illustrates a panel 376 mounted in outer hook 364.

It is to be understood that the versions shown in FIGS. 61–64 may also be practiced where hooks from the wire are used for attachment to the track or deck at either the pan head and/or the pan foot. Where attachment is only at the pan head or at the pan foot the other hook portion could be pressed flat against the pan such as shown in FIG. 11 or could be omitted entirely and the wire could end at the corresponding pan edge or could extend slightly beyond the edge and be bent against the pan.

Figure 65:
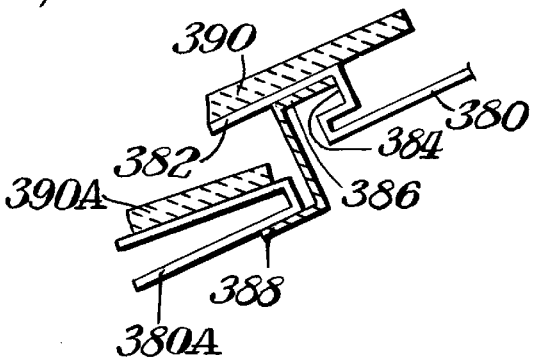
Fig. 65 (Prior Art)
FIG. 65 is an elevational view in section of a prior art type arrangement which includes a pan.

FIG. 65 illustrates a prior art type of arrangement wherein a pan 380 includes an extension 382 forming an open area 384 into which a portion 386 of the track 388 would be inserted. The panel or slate 390 rests on pan 380 and a further panel 390A rests on a lower pan 380A.

Figure 66:
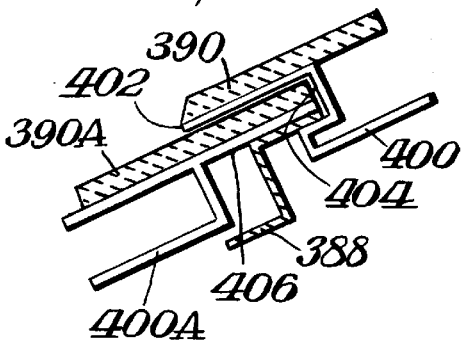
FIG. 66 is a view similar to FIG. 65 showing an embodiment of this invention.

FIG. 66 illustrates a practice of this invention wherein the pan 400 has an extension 402 at its lower or butt end upon which the panel 390 would be placed. A recess 404 is formed by an outwardly extending shoulder or L-shaped extension of the pan 400. As illustrated in FIG. 66 not only does a portion of the track 388 fit into the recess, but also a lower panel 390A and an upwardly extending head 106 from the lower pan 400A fit within the recess 404. By this arrangement there is a close contact or sandwiching of the track/panhead/panel head/pan butt/panel butt. The close surface to surface contact could be obtained by having the recess 404 be resilient as a result of using spring material for butt 390 and the outwardly extending shoulder of pan 400 to press the track/panhead/panel head together. Alternatively a resilient mounting is not necessary where there is proper dimensioning for the pan shoulder/track/panhead/panel head/pan butt. The arrangement thus differs from that of FIG. 65 in providing a tight fit for the components.

Figure 67:
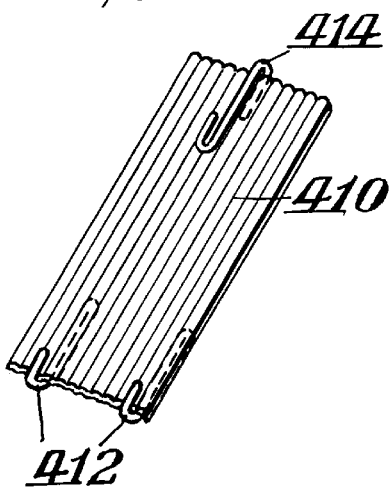
FIG. 67 is a perspective view of yet another embodiment of this invention.

FIG. 67 illustrates a pan 410 similar to pan 360 of FIG. 61. FIG. 67, however, shows the possibility of securing the pan by a plurality of clips 412 at the bottom of pan 410 which would hook over a track and would also be hooked around from the rear face to the front face of the pan. A further fastener 414 would also be provided as previously described to receive a panel. Thus, the embodiment of FIG. 67 exemplifies that if clips, such as clips 412 are to be used to secure the lower portion of the pan 410, two or more clips can be employed. Using at least two clips would, for example, prevent the pan from rotating, thus assuring proper pan alignment.

Figure 68:
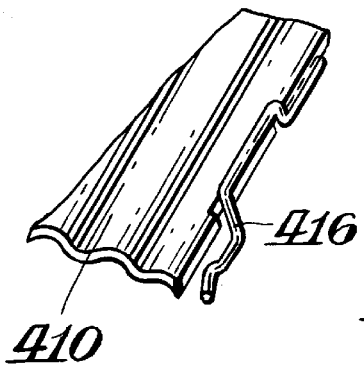
FIG. 68 is a fragmental perspective view of a further embodiment of this invention.
Figure 69:
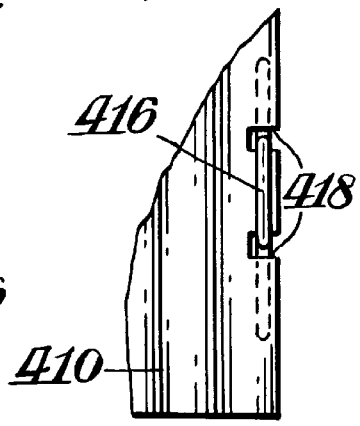
FIG. 69 is a fragmental top plan view of the embodiment shown in FIG. 68.

FIGS. 68–69 illustrate variations of the arrangement of FIG. 67 wherein the pan 410 includes a plurality of clips 416 which are located along the side of pan 410 near the bottom edge. As shown the clip 416 extends through a pair of notches 418 and has a hook formation at its lower end that would hook around the track while the hook formation at the upper end fits snugly against the inner surface of the pan. Although FIGS. 68–69 illustrate the clips 416 to be detachable the clips may be molded as part of the pan structure.

Figure 70:
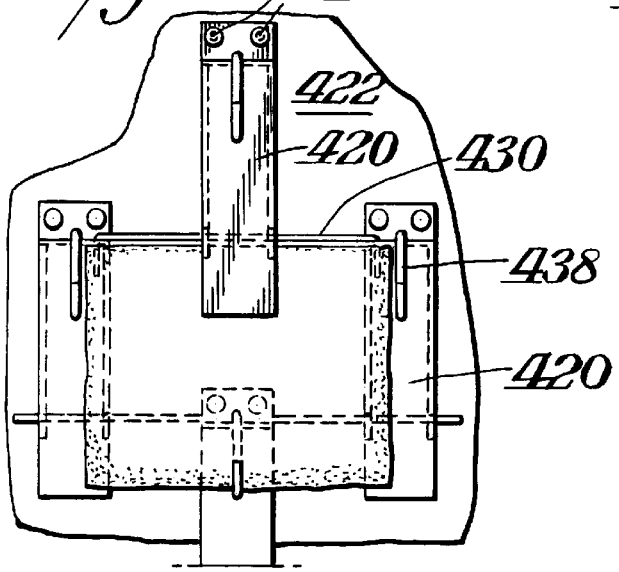
FIG. 70 is a top plan view of yet another variation of this invention.
Figure 71:
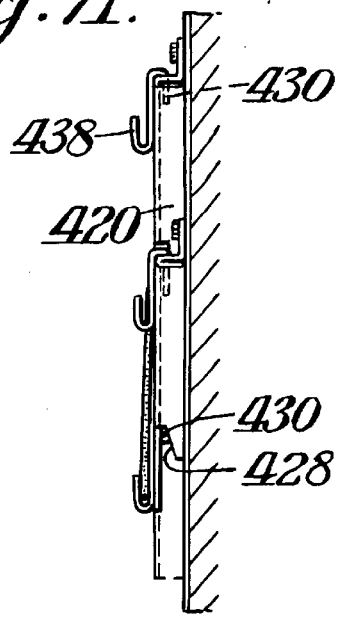
FIG. 71 is a side elevational view of the variation shown in FIG. 70.
Figure 72:
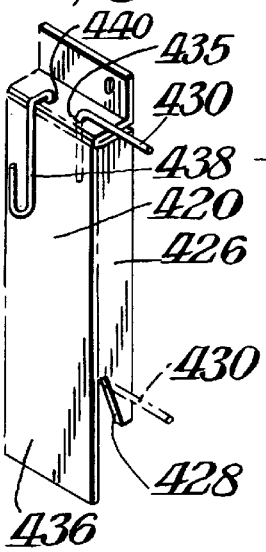
FIG. 72 is a fragmental right side perspective view of the variation shown in FIGS. 70–71.

FIGS. 70–72 show a further variation of the invention wherein the pans 420 are attached directly to the deck 422 by any suitable fasteners 424. In order to provide stability to the mounting each pan includes a side flange 426 having a slot 428. A stabilizing member 430 such as a wire is secured across adjacent lower pans 420 by each of wire 430 inserted into a hole 435 in a vertical wall of a pan, as shown in FIG. 72. The stabilizing member 430 is received in the slots 428 of an upper intermediate pan. In this manner, the head of each pan 420 is firmly mounted directly to the deck by means of fasteners 424 while the base of each pan is secured by its engagement with the wire or stabilizing member 430.

As also shown in FIGS. 70–72 a hook 438 is mounted in a hole 440 in a vertical wall of pan 420. Thus, the hook 438 may receive the base end of a panel.

Figure 73:
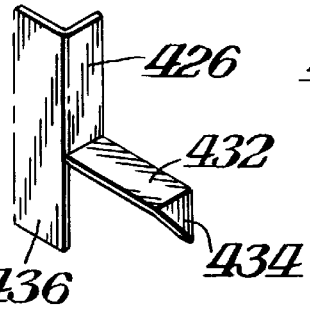
FIG. 73 is a fragmental lower right side elevational view of yet another form of this invention.

FIG. 73 shows a variation of the arrangement of FIGS. 70–72. As shown in FIG. 73 the stabilizing member is a tab 432 integral with the side flange 426 and of sufficient length so that its hook end 434 could be inserted inwardly of the side flange 426. This differs from the embodiment of FIGS. 70–72 where the wire or connecting member 430 is inserted into a hole 435 in pan 420.

Figure 74:
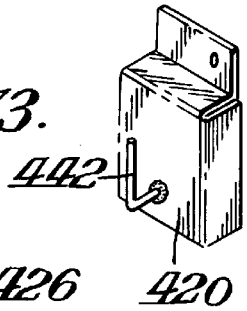
FIG. 74 is a fragmental upper side elevational view showing alternative clip mounting structure.
Figure 75:
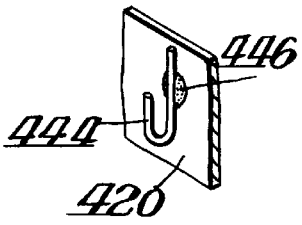
FIG. 75 is a view similar to FIG. 74 of yet another version of this invention.

FIG. 74 shows a variation wherein the hook 442 is integral with the top wall of pan 420. In FIG. 75 the hook 444 is made integral by being welded to pan 420 as shown by the weld material 446.

Figure 76:
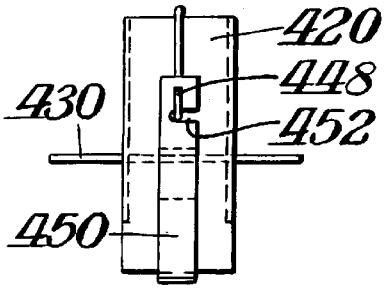
FIG. 76 is a top plan view of still yet another embodiment of this invention.

FIG. 76 shows a variation of the invention where the pan 420 includes structure to hold down the hook 448. As shown therein a band 450 is provided on the top face of pan 420 and includes a slot 452 which receives the hook 448. Band 450 extends around the back side of pan 420 at the base of the pan while hook 448 extends around the back side of the pan at the head of the pan thus providing an arrangement which resists upward lifting of the hook away from pan 420 as might otherwise occur during wind or storm conditions. If desired, band 450 could extend sufficiently up the back side of pan 420 to bend over and engage wire 430.

Figure 77:
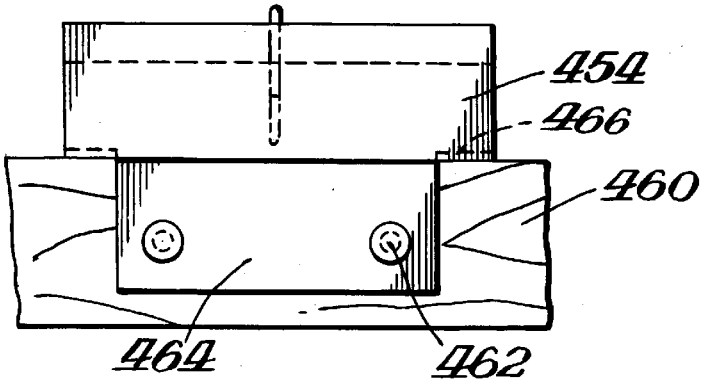
FIG. 77 is a top plan view of yet another form of this invention.
Figure 78:
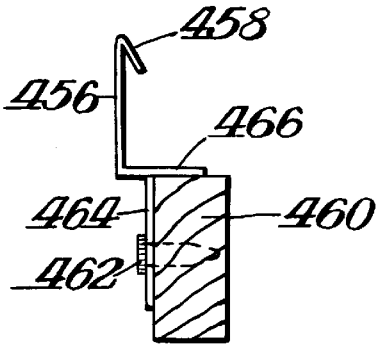
FIG. 78 is a right side elevational view of the form of the invention shown in FIG. 77.

FIGS. 77–78 show an arrangement which utilizes a variation in the track structure. This arrangement could be used with the hook and pan type arrangements previously described or in place of the tracks such as described in my aforenoted patents. As shown in FIGS. 77–78 instead of having an elongated track extending over a major distance of the batten or understructure, aligned spaced track segments 454 are provided which include an upper flange 456 terminating in an inward bend 458 located in the open space between two battens for receiving a clip or the hook end of a pan. In the illustrated embodiment the track segment 454 is mounted directly to a batten 460 by means of fasteners 462 which extend through a stepped down base section 464 of the track segment 454 with a perpendicular wall 466 also disposed against the batten 460.

Figure 79:
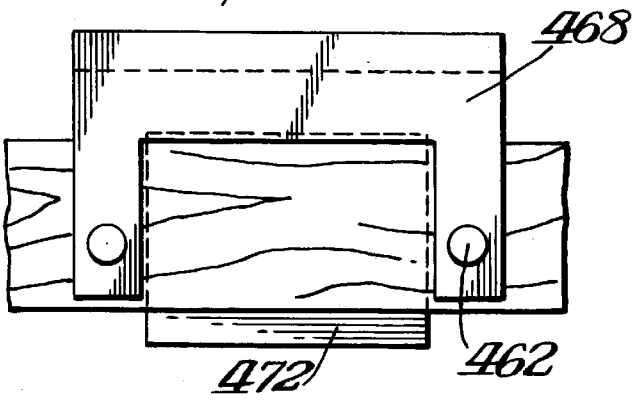
FIG. 79 is a top plan view of still yet another variation of this invention.
Figure 80:
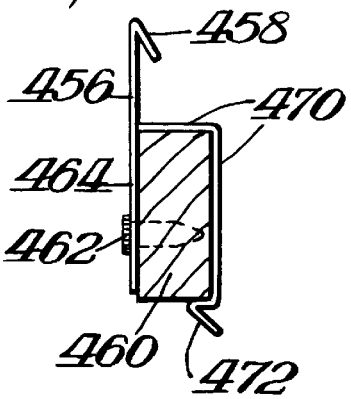
FIG. 80 is a right side elevational view of the variation of the invention shown in FIG. 79.

FIGS. 79–80 show a variation of track segment 468 wherein the wall 470 extends completely around two sides of the batten 460 and terminates in a hook end 472. Base section 464 is also shown as aligned with flange 456.

The embodiments shown in FIGS. 77–78 and 79–80 regarding the track segments would be used wherein the upper wall or flange 456 would function to accommodate panel securing structure such as a pan which holds panels as previously described where the pan hooks over flange 456 to engage hook 458 or a panel held by a clip as described in my aforenoted patents wherein the panel securing structure would be engaged with the hook 458. If desired, hook 458 could be omitted and the exposed edge of flange 456 would be engaged by the pan or clip.

Figure 81:
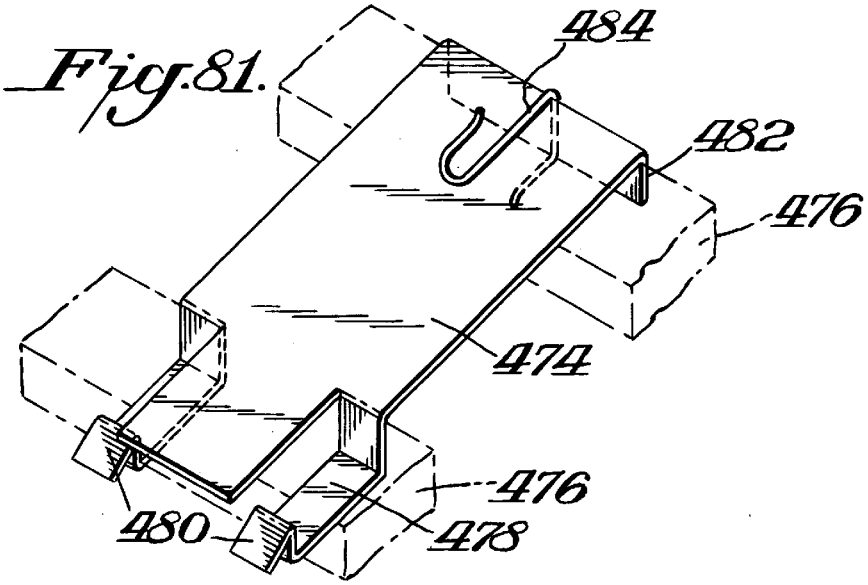
FIG. 81 is a perspective view of still yet another form of this invention.

FIG. 81 illustrates yet another practice of the invention wherein the pan 474 would be secured to spaced battens 476. As shown therein the base end of pan 474 has integral tabs 478 which are notched from the upper surface of pan 474 and extend around the lower batten 476 with each notch 478 terminating in a hook member 480. The upper end of the pan terminates in a downward flange 482 mounted against the upper side edge of the upper batten 476. Pan 474 also includes a hook 484 which extends partially around the batten with the lower end of hook 484 being at the lower wall of the batten and with the upper end terminating in a panel receiving hook.

The version of pan mounting shown in FIG. 81 could be varied by having the tab of shorter dimension and mounted directly to the upper side of the batten by any suitable fastener. Such arrangement could be used where the pan is mounted to a deck.

Another variation of FIG. 81 would be to simply omit the notch/hook structure at the lower end of pan 474 and rely on the flange 482 and hook 484 to secure the pan to the batten 476.

In general, the invention is directed to covering systems for roofs wherein roofing panels such as slates are utilized. In any roofing assembly the panel or slate sheds water and passes the water to the next panel. The present invention reduces the quantity of panels or shingles by replacement of some of the shingles with substitute components. This is particularly cost advantageous where the shingles or panels are relatively expensive slate materials. In the practice of the invention the substitute shingles are the pans. While the pans or substitute shingles may not be visible they, nevertheless, do function as shingles. In a typical practice of the invention there are as many concealed shingles as there are visible shingles. Thus, the concealed shingles or pans are not an incidental component in the assembly but represent a component every bit as important as the panel or slate itself.

While the previously noted '596 patent system also uses pan type structure, the present invention is more advantageous by providing a compliant engagement of the panels or shingles to the roof structure and thus avoids the non-compliant engagement of the prior art. By offering a compliant fit with the invention, whether the fit or engagement is at the top or bottom or both, practice of the present invention permits the accommodating of the natural inherent differences that exist, for example, in the slate thickness thereby assuring a tight fit regardless of these differences. With the '596 patent system a gap results between the lower surface of a pan and the upper surface of the underlying panel where the underlying panel is thin. Situating the upper end of the underlying panel on the lower flange of the track and the lower end of the overlying panel on the upper flange of the track makes this gap unavoidable. In contrast, the present invention urges the surfaces to contact each thus eliminating gaps and unsupported or cantilevered areas for the panel. The invention would be practiced with no gaps that admit weather and present no unsupported ends which would be prone to breakage. Not only is the attachment of the pan to the supporting structure compliant but so too is the hooked attachment of the slate or panel to the pan/track/deck. This distinctly differs from the '596 patent system utilizing bent-up tabs which are not compliant.

It is to be understood that various features shown and described with particular embodiments may be incorporated in other embodiments of this invention within the spirit of the invention.

What is claimed is:

1. A covering assembly for covering a roof or side of a structure comprising an understructure, a plurality of spaced parallel tracks mounted to said understructure, each of said mounting tracks having a base portion secured to said understructure and an intermediate connecting portion extending away from said base portion with an offset portion extending away from said intermediate portion generally parallel to said base portion, said offset portion terminating in a bent end extending toward said base portion, a plurality of covering panels, each of said covering panels having an exposed side and an underside, a resilient clip mounted around said panel and detachably hooked to said offset portion of said track, said clip having a first free end disposed against said exposed side of said panel and a second free end extending around said offset portion of said track, said second free end terminating in a bent portion hooked around said bent end of said offset portion, and said panels being disposed in rows with each of the panels in a respective row detachably mounted to one of said tracks and with said rows of panels overlapping each other.

2. The assembly of claim 1 wherein said bent end of said offset portion is a barb extending away from said intermediate connecting portion, and said bent portion of said clip is a barb extending toward said intermediate portion.

3. The assembly of claim 1 wherein said bent end of said offset portion is inclined toward said intermediate portion, and said bent portion of said clip being inclined away from said intermediate portion.

4. The assembly of claim 1 wherein said clip includes recessed reinforcing structure.

5. The assembly of claim 1 wherein said track includes stiffening structure.

6. The assembly of claim 1 wherein a detachable sheath is on said offset portion of said track.

7. A covering assembly for covering a roof or side of a structure comprising an understructure, a plurality of rows of elongated pans, a plurality of rows of covering panels, each of said pans having a central portion defined by elongated side edges joined by upper and lower edges, a hook structure extending generally from one of said edges, said hook structure having a first surface extending downwardly away from said central portion and joined to a second surface generally parallel to said central portion disposed directly below and spaced from said central portion, said hook structure thereby including three mounting surfaces comprising said central portion and the downward extension and said second surface, each of said pans being detachably mounted to said understructure by said hook structure being hooked around and against said understructure, adjacent rows of said pans being mounted to overlap each other with said lower edges of one row of said pans overlapping said upper edges of an adjacent lower row of said pans, each of said panels having elongated side edges joined by upper and lower edges, each of said rows of panels comprising adjacent panels having side edges disposed generally against each other to create sets of longitudinal joints at said side edges of adjacent panels, said panels being disposed over said pans and staggered with respect to said pans, each said pans having a front surface and a rear surface, a panel receiving hook on said front surface detachably mounting said panels to said understructure with said pans located at and below each of said joints, each of said joints being at a location between said side edges of said pan, said location of said pan being imperforate, said pans and said panels being compliantly and tightly mounted to said understructure, the undersurface of a pan being in contact with the outer surface of an underlying panel, and said pan being of generally the same length as said panels at said location of said joint to generally prevent flow of water through said joint directly to said understructure.

8. The assembly of claim 7 wherein said panel receiving hook is formed by a wire having a hook formation on said front surface of said pan, and said wire extending around to said rear surface of said pan.

9. The assembly of claim 8 wherein said wire extends only partially around said rear surface.

10. The assembly of claim 8 wherein said pan has corrugations extending from said upper edge to said lower edge to provide guide recesses for placement of said wire.

11. The assembly of claim 8 wherein said wire terminates in an upper free end at said rear surface of said pan, and a lower free end at said rear surface of said pan each of said free ends having a downwardly disposed hook.

12. The assembly of claim 11 wherein said upper hook and said lower hook are disposed around tracks mounted to said understructure.

13. The assembly of claim 11 wherein said upper hook is disposed between said rear surface of said pan and a track mounted to said undersurface.

14. The assembly of claim 11 wherein said upper hook is mounted around said understructure.

15. The assembly of claim 11 wherein said lower edge of said pan includes a generally L-shaped extension forming a spacing between said rear surface of said pan and the free end of said L-shaped extension, and said spacing being filled by surface to surface contact between said rear surface of said pan and an underlying one of said panels and an underlying one of said pans and an offset portion of a track mounted to said understructure with an overlying panel being mounted against said front surface of said pan.

16. The assembly of claim 7 wherein a pair of said hook structures is provided at said lower edge of said pan.

17. The assembly of claim 7 wherein said hook structure is located at at least one of said side edges.

18. The assembly of claim 7 wherein said hook structure is detachably mounted to said pan.

19. A covering assembly for covering a roof or side of a structure comprising an understructure, a plurality of rows of aligned pans, said pans in each of said rows being spaced from each other, each of said pans having an upper head portion and a lower base portion said head portion being fastened to said understructure, a stabilizing member spanning and connecting a pair of lower adjacent pans, said base portion of an upper pan being located between said pair of lower adjacent pans and engaged with said stabilizing member, and hook structure on each of said pans for receiving a panel.

20. The assembly of claim 19 wherein each of said pans includes a side wall having a slot, said stabilizing member being a wire, and said wire disposed in said slot.

21. The assembly of claim 19 wherein each of said pans has a pair of parallel side walls, each of said side walls having an integral tab, and said integral tab extending to and connected to one of said lower adjacent pans to comprise said stabilizing member.

22. The assembly of claim 19 wherein said hook is integral with said pan.

23. The assembly of claim 19 including a hold down band for holding said hook against said pan during wind and storm conditions, said hold down band having a cut out, said hook being disposed in said cut out, and said hold down band extending around said base of said pan to the undersurface of said pan.

24. A covering assembly for covering a roof or side of a structure comprising an undersurface in the form of a plurality of spaced battens, a plurality of pans, each of said pans having a head end and a base end, each of said pans having an upper surface, said head end terminating in a downwardly extending flange disposed against an upper batten, said base end having integral tabs secured to a lower one of said battens, a hook mounted to said head end, and a panel received in said hook.

25. The assembly of claim 24 wherein said integral tabs extend around at least two side walls of said batten.

26. A covering assembly for covering a roof or side of a structure in the form of a plurality of spaced battens, a plurality of spaced aligned track segments on each of said battens, each of said track segments having an upper flange which extends away from said batten and terminates in a free end located in an open space between pairs of adjacent battens, each of said track segments having a side wall disposed against a side wall of said batten each of said track segments having a lower base section disposed against and fastened to a second side wall of said batten, and a panel assembly mounted against said upper wall and engaged with said free end of said upper flange.

27. The assembly of claim 26 wherein said free end of said upper flange terminates in a hook structure.

* * * * *